US011110571B2

(12) United States Patent
Lai

(10) Patent No.: US 11,110,571 B2
(45) Date of Patent: Sep. 7, 2021

(54) SWITCH DEVICE AND RATCHET WRENCH HAVING THE SAME

(71) Applicant: HAUR YUEH CO., LTD., Taichung (TW)

(72) Inventor: Ying-Liang Lai, Taichung (TW)

(73) Assignee: HAUR YUEH CO., LTD., Taichung (TW)

( * ) Notice: Subject to any disclaimer, the term of this patent is extended or adjusted under 35 U.S.C. 154(b) by 196 days.

(21) Appl. No.: 16/553,494

(22) Filed: Aug. 28, 2019

(65) Prior Publication Data

US 2021/0060738 A1 Mar. 4, 2021

(51) Int. Cl.
*B25B 13/46* (2006.01)

(52) U.S. Cl.
CPC ..... *B25B 13/463* (2013.01)

(58) Field of Classification Search
USPC ..... 81/62, 63.1
See application file for complete search history.

(56) References Cited

U.S. PATENT DOCUMENTS

| | | | | |
|---|---|---|---|---|
| 6,260,448 | B1 * | 7/2001 | Chaconas | B25B 13/463 81/60 |
| 6,382,052 | B1 * | 5/2002 | Chen | B25B 13/463 81/63 |
| 7,082,859 | B2 * | 8/2006 | Huang | B25B 13/463 81/62 |
| 2019/0061112 | A1 | 2/2019 | Lai | |

FOREIGN PATENT DOCUMENTS

| | | | |
|---|---|---|---|
| CN | 1572427 | A | 2/2005 |
| CN | 205033128 | U | 2/2016 |
| TW | M556197 | U | 3/2018 |
| TW | M559222 | U | 5/2018 |
| TW | I652147 | B | 3/2019 |

OTHER PUBLICATIONS

Search Report appended to an Office Action, which was issued to Taiwanese counterpart application No. 108106454 by the TIPO dated Sep. 27, 2019, with an English translation thereof.
Search Report appended to an Office Action, which was issued to Chinese counterpart application No. 202010009092.5 by the CNIPA dated Apr. 1, 2021, with an English translation thereof.

* cited by examiner

*Primary Examiner* — Hadi Shakeri
(74) *Attorney, Agent, or Firm* — Burris Law, PLLC

(57) ABSTRACT

A switch device includes a shell, a ratchet wheel, a first pawl member, a second pawl member, a first biasing member, a second biasing member, a switch shaft, and a stop member. The shafting shaft is disposed to turnably engage a central segment of the stop member. Two lateral segments of the stop member are disposed respectively above the first and second pawl members, and respectively have two abutment edges that are disposed opposite to the ratchet wheel, and that are configured to be brought into abutting engagement with a surrounding wall of the shell so as to prevent the switch shaft from pulling out of the shell. A ratchet wrench having the switch device is also disclosed.

4 Claims, 8 Drawing Sheets

SWITCH DEVICE AND RATCHET WRENCH HAVING THE SAME

FIELD

The disclosure relates to a switch device, more particularly to a ratchet wrench having a switch device.

BACKGROUND

Taiwanese patent No. 1652147, corresponding to U.S. patent publication application No. US 2019/0061112 A1, discloses a conventional ratchet wrench, which, as shown in FIGS. 1 and 2, includes a head shell 11, a ratchet wheel 12 rotatably mounted inside the head shell 11, first and second pawl members 13, 14 for ratchet engagement with the ratchet wheel 12 at two opposite sides of the ratchet wheel 12, and a switch unit 15. The switch unit 15 includes a switch shaft 151, a limiting ring 152, and an actuating finger 153. The actuating finger 153 extends radially from an upper end of the switch shaft 151 and is disposed outwardly of the head shell 11. The switch shaft 151 is pivotally mounted to the head shell 11, and has a lower cam segment 154 and an annular groove 155 which is formed between the lower cam segment 154 and the upper end of the switch shaft 151 inside the head shell 11. The limiting ring 152 is partially received in the annular groove 155 to permit the switch shaft 151 to have an enlarged dimension segment so as to prevent the switch shaft 151 from pulling out of the head shell 15. When the actuating finger 153 is actuated to turn the switch shaft 151, the lower cam segment 154 is turned to permit only a selected one of the first and second pawl members 13, 14 to be in ratchet engagement with the ratchet wheel 12.

However, after the conventional ratchet wrench is used for a period of time, the limiting ring 152 may be disengaged from the annular groove 155 to engage with one of the first and second pawl members 13, 14, which may obstruct turning of switch shaft 151.

SUMMARY

Therefore, an object of the disclosure is to provide a novel switch device with a stop member which may effectively retain a switch shaft inside a shell. Another object of the disclosure is to provide a ratchet wrench having the switch device.

According to a first aspect of the disclosure, a switch device includes a shell, a ratchet wheel, a first pawl member, a second pawl member, a first biasing member, a second biasing member, a switch shaft, and a stop member. The shell has an upper major wall, and a surrounding wall extending downwardly from a periphery of the upper major wall to define an inner space. The ratchet wheel is rotatably mounted inside the inner space about a first axis. The first and second pawl members are pivotally mounted inside the inner space, and are disposed at two opposite sides of the ratchet wheel. Each of the first and second pawl members is angularly movable between an idle position, where a respective one of the first and second pawl members is spaced apart from the ratchet wheel, and an engaging position, where the respective one of the first and second pawl members is in ratchet engagement with the ratchet wheel to permit the ratchet wheel to rotate in a respective one of clockwise and counterclockwise directions only. Each of the first and second biasing members is disposed to bias a respective one of the first and second pawl members to the engaging position. The switch shaft is mounted pivotally to the upper major wall about a second axis which is parallel to and offset from the first axis. The switch shaft includes an upper actuating end, a lower cam segment, and a middle segment. The upper actuating end is disposed outwardly of the upper major wall. The lower cam segment is disposed between the first and second pawl members, and is configured such that when one of the first and second pawl members is in the idle position, the other one of the first and second pawl members is in the engaging position. The middle segment is disposed between the upper actuating end and the lower cam segment in the inner space, and is formed with a retaining groove about the second axis. The stop member has a central segment and two lateral segments. The central segment is configured to be partially engaged in the retaining groove so as to permit the switch shaft to turnably engage the stop member. The lateral segments are disposed respectively above the first and second pawl members, and respectively have two abutment edges that are disposed opposite to the ratchet wheel, and that are configured to be brought into abutting engagement with the surrounding wall so as to prevent the switch shaft from pulling out of the shell.

According to a second aspect of the disclosure, a ratchet wrench includes the switch device, a handle extending radially from the surrounding wall to terminate at a handgrip, and a driving member extending downwardly from the ratchet wheel and out of the inner space along the first axis to permit the ratchet wheel to rotate with the driving member about the first axis.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Figure 1:
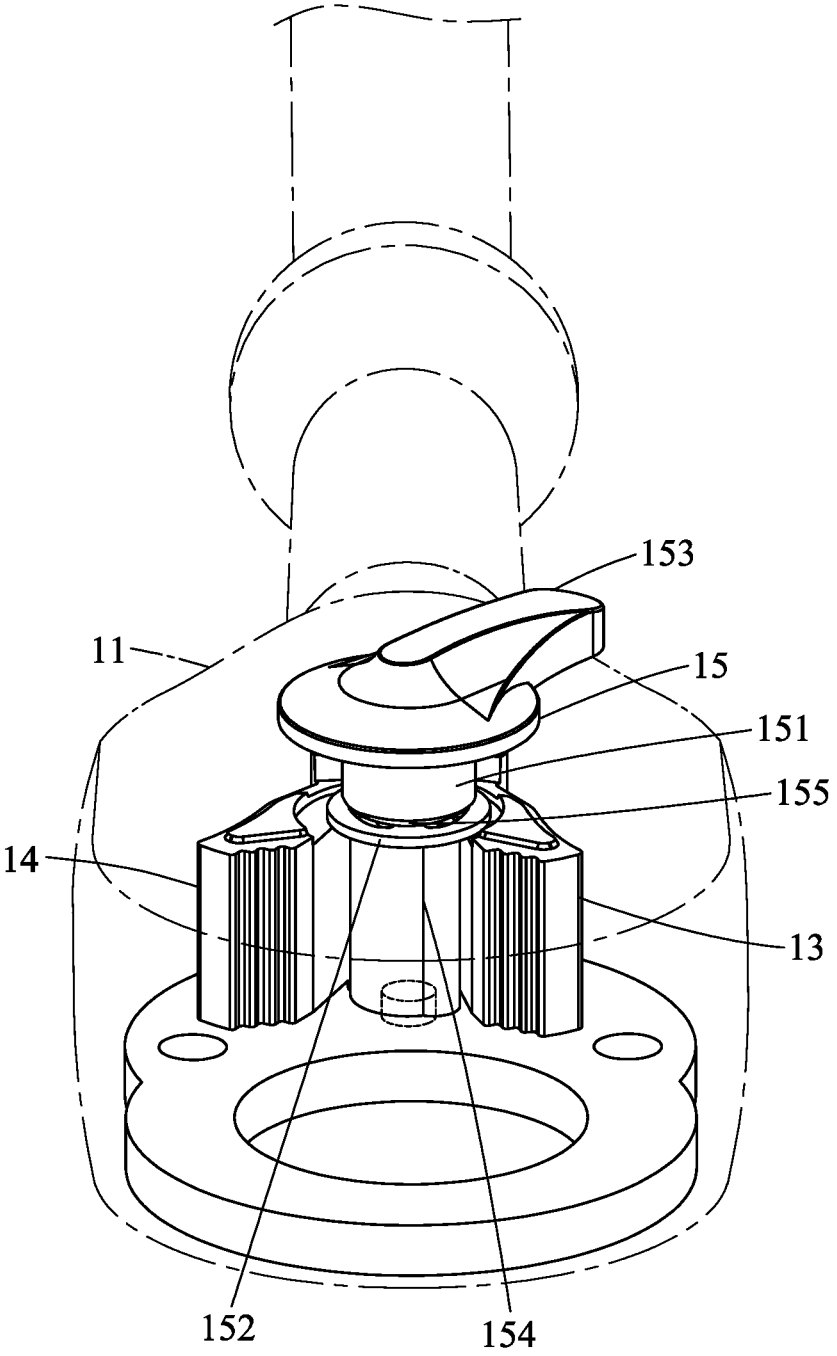
FIG.1 PRIOR ART
FIG. 1 is a perspective view illustrating some elements of a conventional ratchet wrench.
Figure 2:
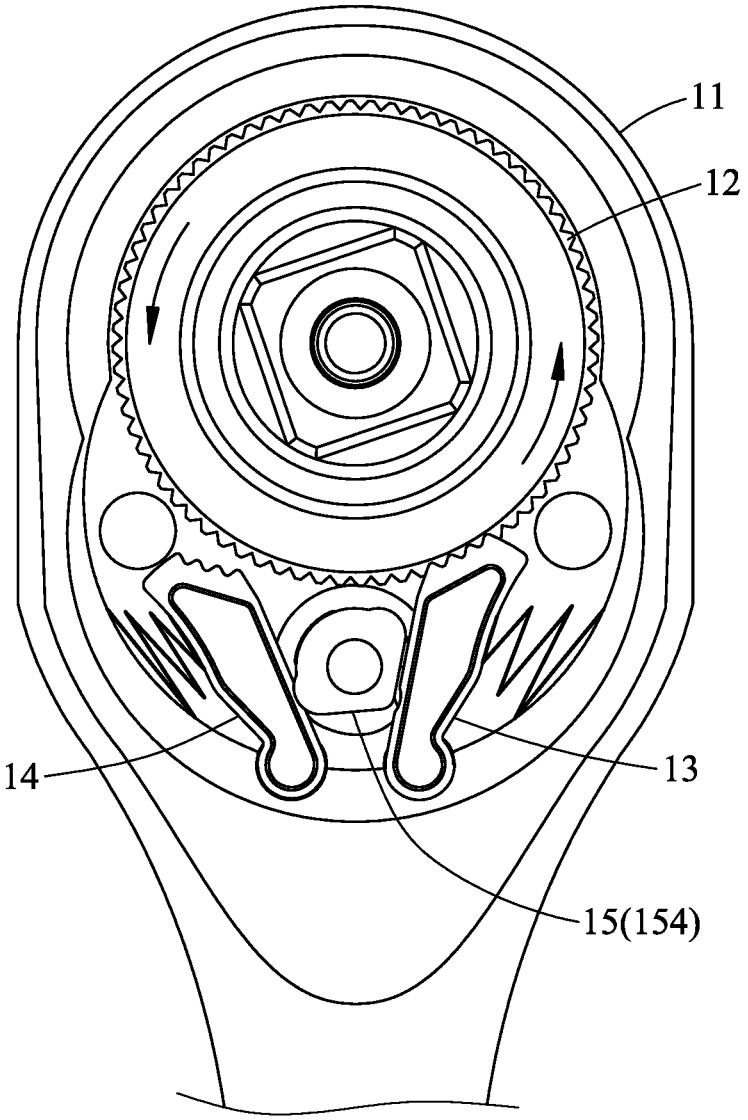
FIG.2 PRIOR ART
FIG. 2 is a schematic view illustrating a lower cam segment of a switch shaft of the conventional ratchet wrench being turned to permit only a selected one of first and second pawl members to be in ratchet engagement with a ratchet wheel.
Figure 3:
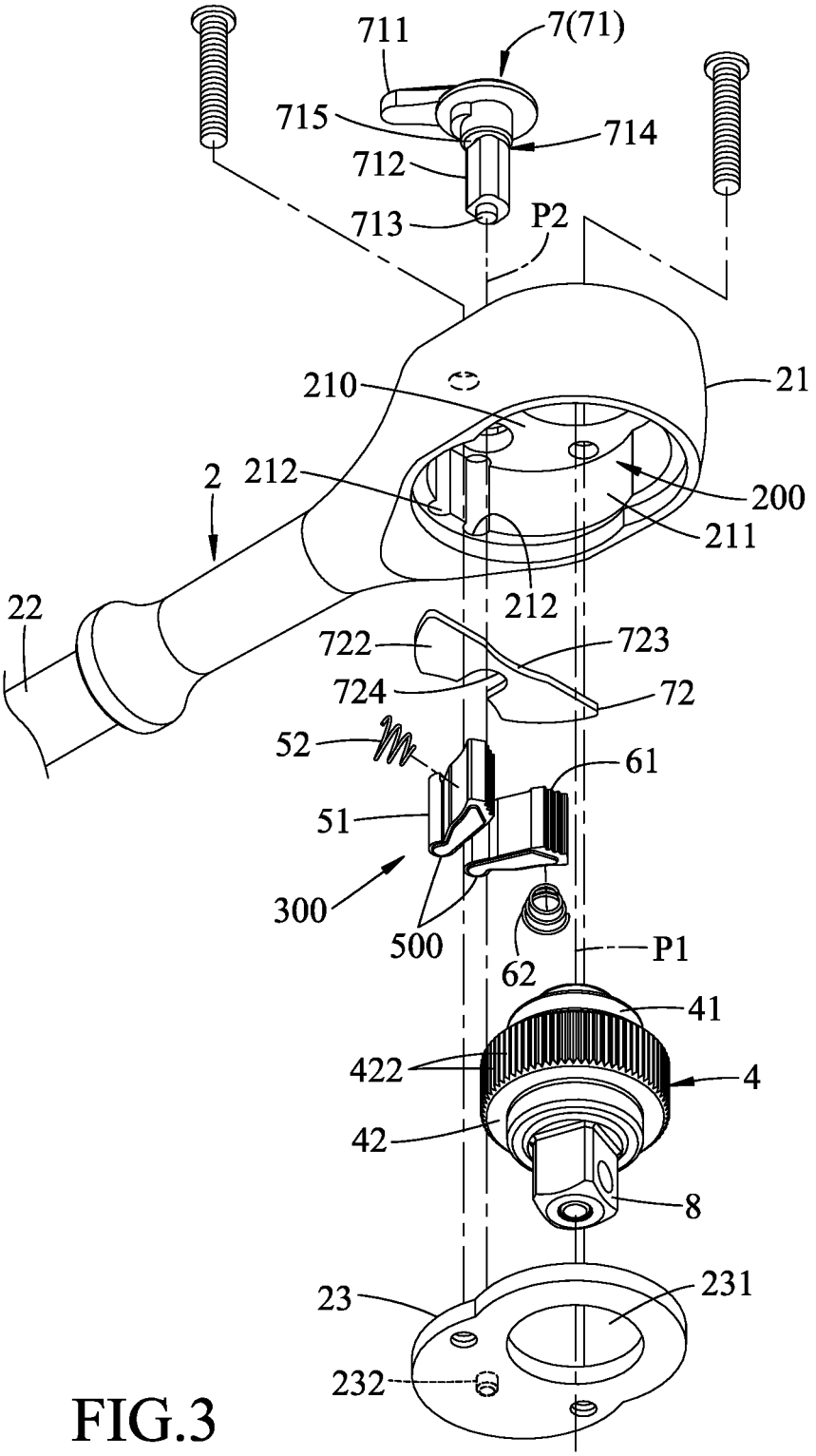
FIG. 3 is an exploded perspective view of a ratchet wrench according to an embodiment of the disclosure.
Figure 4:
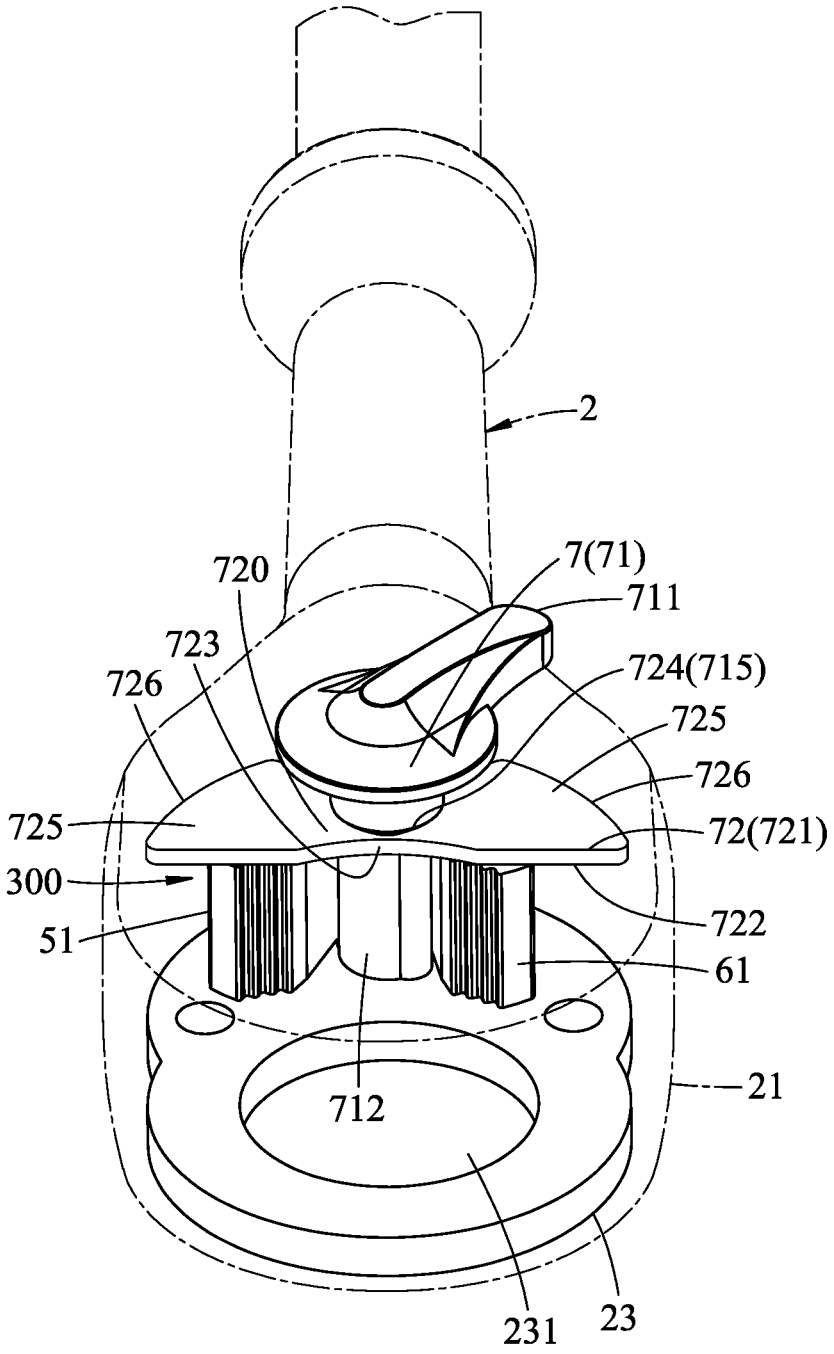
FIG. 4 is perspective view illustrating some elements of the embodiment in an assembled state.
Figure 5:
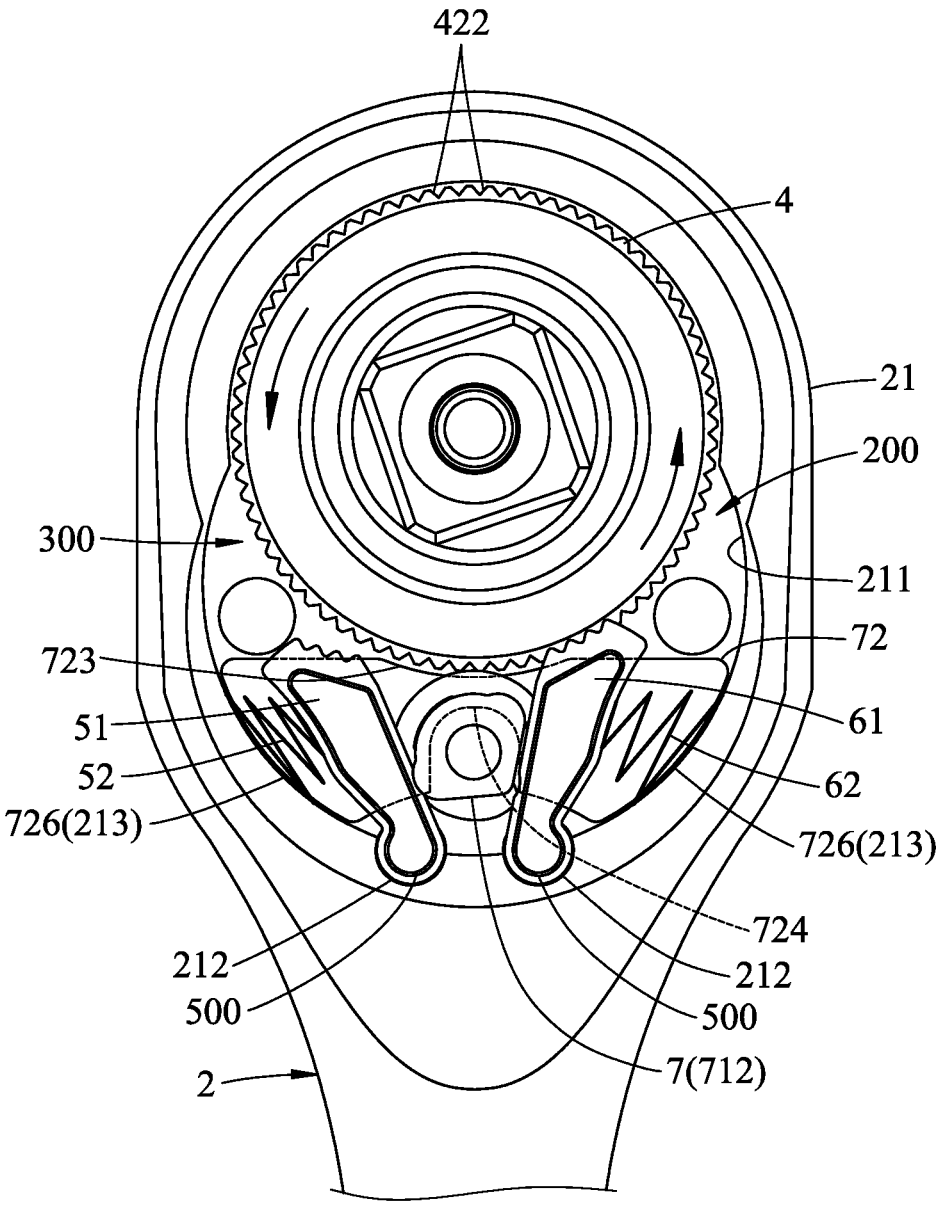
FIG. 5 is a schematic view illustrating first and second pawl members in the embodiment respectively in an idle position and an engaging position.

Referring to FIGS. 3 to 5, a ratchet wrench according to an embodiment of the disclosure is shown to include a switch device 300, a handle 2, and a driving member 8.

The switch device 300 includes a shell 21, a ratchet wheel 4, a first pawl member 51, a second pawl member 61, a first biasing member 52, a second biasing member 62, a switch shaft 7, and a stop member 72.

The shell 21 has an upper major wall 210, and a surrounding wall 211 extending downwardly from a periphery of the upper major wall 210 to define an inner space 200. In an embodiment shown in FIG. 3, an inner surface of the surrounding wall 211 is formed with two groove sockets 212.

The ratchet wheel 4 is rotatably mounted inside the inner space 200 about a first axis (P1). In an embodiment shown in FIG. 3, the ratchet wheel 4 includes a central portion 41 and a rim portion 42 extending radially from a middle area of the central portion 41 to have a plurality of teeth 422 displaced from each other about the first axis (P1).

Figure 6:
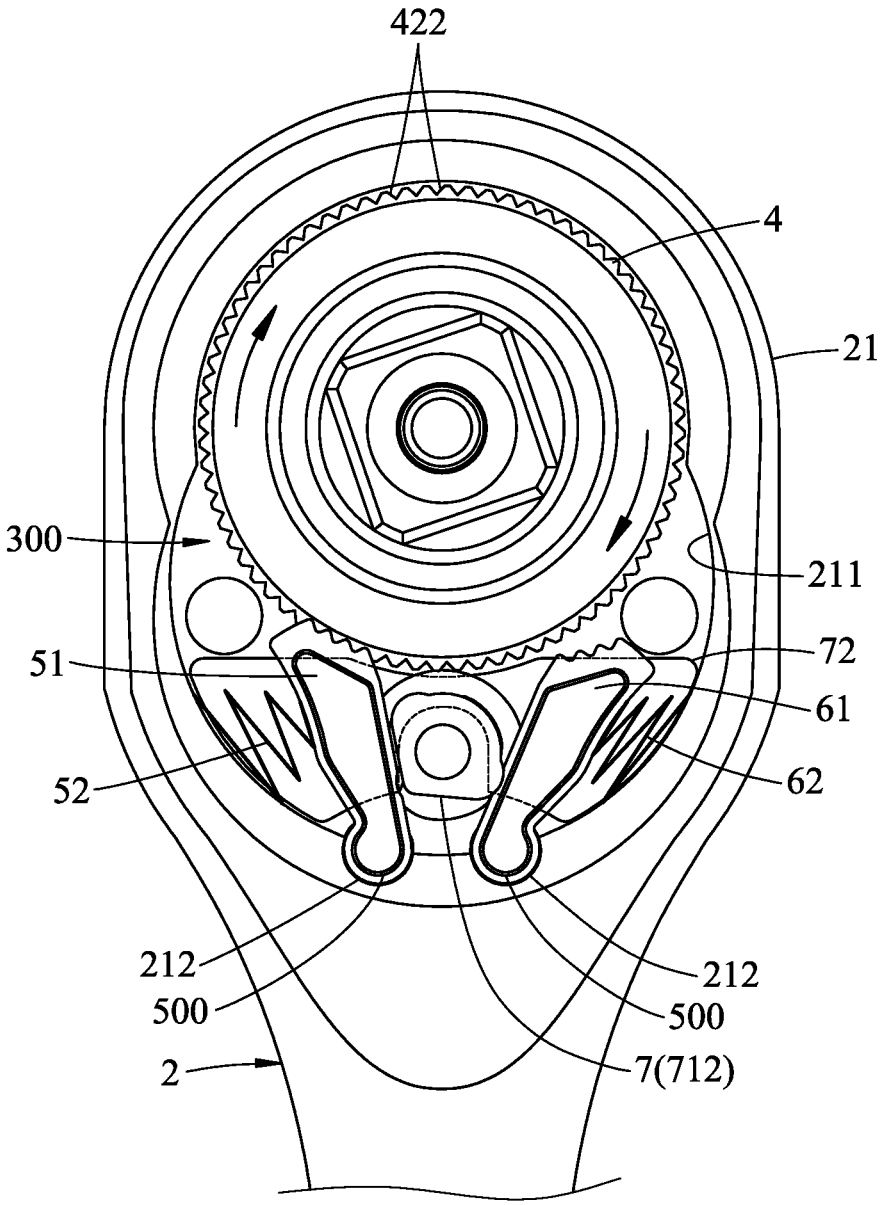
FIG. 6 is similar to FIG. 5 but illustrating the first and second members respectively in an engaging position and an idle position.

The first and second pawl members 51, 61 are pivotally mounted inside the inner space 200, and are disposed at two opposite sides of the ratchet wheel 4. Each of the first and second pawl members 51, 61 is angularly movable between an idle position, where a respective one of the first and second pawl members 51, 61 is spaced apart from the ratchet wheel 4, and an engaging position, where the respective one of the first and second pawl members 51, 61 is in ratchet engagement with the ratchet wheel 4 to permit the ratchet wheel 4 to rotate in a respective one of clockwise and counterclockwise directions only. In FIG. 5, the first pawl member 51 is in the idle position, the second pawl member 61 is in the engaging position, and the ratchet wheel 4 is permitted to rotate in the counterclockwise direction only. In FIG. 6, the second pawl member 61 is in the idle position, the first pawl member 51 is in the engaging position, and the ratchet wheel 4 is permitted to rotate in the clockwise direction only. In an embodiments shown in FIGS. 3, 5, and 6, a pivot end of each of the first and second pawl members 51, 61 may have a rounded surface 500 configured to be hingedly mounted in a respective one of the groove sockets 212.

As shown in FIGS. 5 and 6, each of the first and second biasing members 52, 62 is disposed to bias a respective one of the first and second pawl members 51, 61 to the engaging position.

As shown in FIGS. 3 and 4, the switch shaft 7 is mounted pivotally to the upper major wall 210 about a second axis (P2) which is parallel to and offset from the first axis (P1). The switch shaft 7 includes an upper actuating end 71, a lower cam segment 712, and a middle segment 714. The upper actuating end 71 is disposed outwardly of the upper major wall 210. The lower cam segment 712 is disposed between the first and second pawl members 51, 52, and is configured such that when one of the first and second pawl members 51, 52 is in the idle position, the other one of the first and second pawl members 51, 52 is in the engaging position. The middle segment 714 is disposed between the upper actuating end 71 and the lower cam segment 712 in the inner space 200, and is formed with a retaining groove 715 about the second axis (P2).

In an embodiment shown in FIG. 3, the ratchet wrench may further include an actuating finger 711 which extends radially from the upper actuating end 71 for manual operation, and a cover plate 23 which is coupled to the surrounding wall 211 to cover the inner space 200, and which is formed with a through bore 231. In addition, the switch shaft 7 may further have a bottom pin end 713 which is journalled within a bearing recess 232 formed in the cover plate 23.

Regarding the detail structure and operations for the switch device 300 (excepting the stop member 72), reference can be made to U.S. patent publication application No. US 2019/0061112 A1, the disclosure of which is incorporated in its entirety herein by reference.

As shown in FIGS. 3 to 5 and 8, the stop member 72 has a central segment 720 and two lateral segments 725. The central segment 720 is configured to be partially engaged in the retaining groove 714 so as to permit the switch shaft 7 to turnably engage the stop member 72. The lateral segments 725 are disposed respectively above the first and second pawl members 51, 61, and respectively have two abutment edges 726 that are disposed opposite to the ratchet wheel 4, and that are configured to be brought into abutting engagement with the surrounding wall 211 so as to prevent the switch shaft 7 from pulling out of the shell 21. In addition, because the stop member 72 has the central segment 720 which permits the switch shaft to turnably engage the stop member 72, and the lateral segments 725 which are respectively in abutting engagement with two surfaces regions 213 of the surrounding wall 211, the stop member 72 is less likely to detach from the switch shaft 7 during turning of the switch shaft 7.

Figure 8:
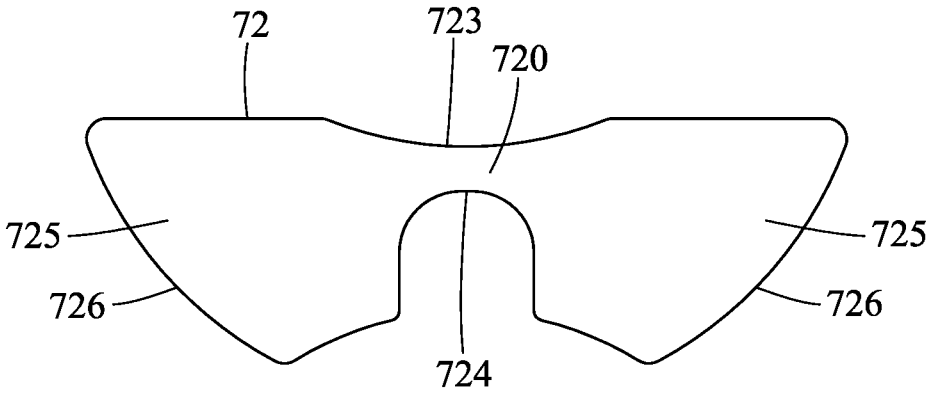
FIG. 8 is a plan view of a stop member of the embodiment.

In an embodiment shown in FIGS. 3, 4, and 8, a portion of the central segment 720 is cut out to form a curved edge 724 configured to be received and retained in the retaining groove 715. The stop member 72 has an upward surface 721 and a downward surface 722 which is configured to permit each of the first and second pawl members 51, 52 to be in movable contact therewith. Thus, the operation of the first and second pawl members 51, 52 is less likely to be obstructed by the stop member 72.

In an embodiment shown in FIGS. 3 and 8, the stop member 72 further has a limiting edge 723 which is configured to permit the ratchet wheel 4 to be in rotatable contact therewith so as to ensure that each of the first and second pawl members 51, 61 is in movable contact with the downward surface 722 of the stop member 72. In addition, shifting movement of the stop member 72 may be limited by the ratchet wheel 4.

In an embodiment shown in FIG. 8, the stop member 72 is an integrally formed metal sheet.

Figure 7:
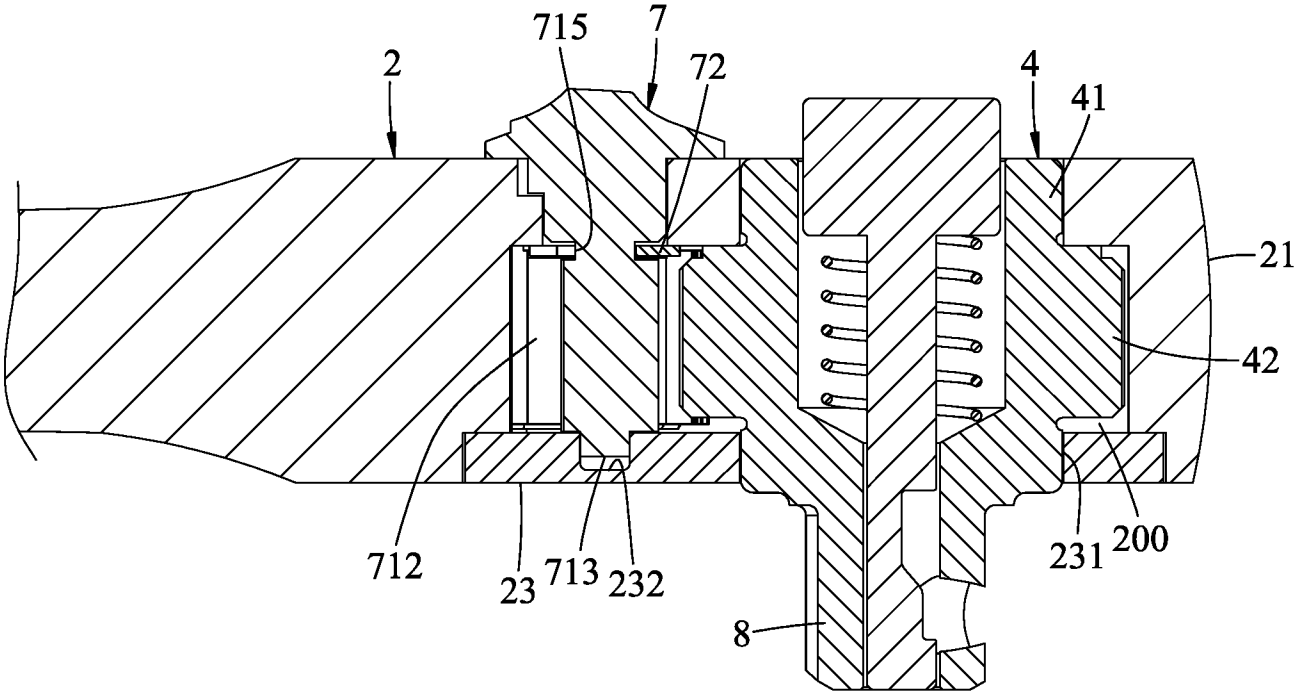
FIG. 7 is a fragmentary cross-sectional view of the embodiment.

Referring back to FIGS. 3 and 7, it is shown that the handle 2 extends radially from the surrounding wall 211 to terminate at a handgrip 22. The driving member 8 extends downwardly from the central portion 41 of the ratchet wheel 4 through the through bore 231 and out of the inner space 200 along the first axis (P1) to permit the ratchet wheel 4 to rotate with the driving member 8 about the first axis (P1).

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A switch device comprising:

a shell having an upper major wall, and a surrounding wall extending downwardly from a periphery of said upper major wall to define an inner space;

a ratchet wheel rotatably mounted inside said inner space about a first axis;

a first pawl member and a second pawl member, which are pivotally mounted inside said inner space, and which are disposed at two opposite sides of said ratchet wheel, each of said first and second pawl members being angularly movable between an idle position, where a respective one of said first and second pawl members is spaced apart from said ratchet wheel, and an engaging position, where the respective one of said first and second pawl members is in ratchet engagement with said ratchet wheel to permit said ratchet wheel to rotate in a respective one of clockwise and counterclockwise directions only;

a first biasing member and a second biasing member each of which is disposed to bias a respective one of said first and second pawl members to the engaging position;

a switch shaft mounted pivotally to said upper major wall about a second axis which is parallel to and offset from the first axis, said switch shaft including an upper actuating end disposed outwardly of said upper major wall, a lower cam segment disposed between said first and second pawl members, and configured such that when one of said first and second pawl members is in the idle position, the other one of said first and second pawl members is in the engaging position, and a middle segment which is disposed between said upper actuating end and said lower cam segment in said inner space, and which is formed with a retaining groove about the second axis; and a stop member having a central segment configured to be partially engaged in said retaining groove so as to permit said switch shaft to turnably engage said stop member, and two lateral segments which are disposed respectively above said first and second pawl members, and which respectively have two abutment edges that are disposed opposite to said ratchet wheel, and that are configured to be brought into abutting engagement with said surrounding wall so as to prevent said switch shaft from pulling out of said shell, wherein said stop member has a downward surface configured to permit each of said first and second pawl members to be in movable contact therewith; and wherein a portion of said central segment is cut out to form a curved edge configured to be received and retained in said retaining groove, said stop member further having a limiting edge which is configured to permit said ratchet wheel to be in rotatable contact therewith so as to ensure that each of said first and second pawl members is in movable contact with said downward surface of said stop member.

2. The switch device according to claim 1, wherein said central segment is partially engaged in said retaining groove.

3. The switch device according to claim 1, wherein said stop member is an integrally formed metal sheet.

4. A ratchet wrench comprising:

said switch device according to claim 1;

a handle extending radially from said surrounding wall to terminate at a handgrip; and a driving member extending downwardly from said ratchet wheel and out of said inner space along the first axis to permit said ratchet wheel to rotate with said driving member about the first axis.

* * * * *